United States Patent [19]

Kirino et al.

[11] Patent Number: 4,457,819

[45] Date of Patent: Jul. 3, 1984

[54] METHOD OF DELUSTERING AN ELECTROCOATED ARTICLE

[75] Inventors: Hisa Kirino; Yukenobu Yabumoto; Iakashi Iritani; Masao Suga, all of Funabashi; Yukenaga Nakanishi, Yokohama, Masaru Itoh, Miuro, all of Japan

[73] Assignees: Nippon Paint Co., Ltd., Osaka; Nippon Light Metal Co. Ltd., Tokyo, both of Japan

[21] Appl. No.: 453,958

[22] Filed: Dec. 28, 1982

[30] Foreign Application Priority Data

Dec. 28, 1981 [JP] Japan ..... 56-214419

[51] Int. Cl.[3] ..... C25D 13/00; C25D 13/04

[52] U.S. Cl. ..... 204/181 R

[58] Field of Search ..... 204/181 R, 181 C, 181 T, 204/299 EC, 300 EC, 181 E

[56] References Cited

FOREIGN PATENT DOCUMENTS 947235 5/1974 Canada ..... 204/181 R
55-54595 4/1980 Japan .
56-9392 1/1981 Japan .

*Primary Examiner*—John F. Niebling

*Assistant Examiner*—B. J. Boggs, Jr.

*Attorney, Agent, or Firm*—Wenderoth, Lind & Ponack

[57] ABSTRACT

The present invention provides a method of delustering an electrocoated article which comprises dipping an uncured electrocoated article into an aqueous solution of an organic sulfonic acid, and applying electric voltage to the article. Further, the present invention provides a method of controlling the gloss of an electrocoated article which comprises electrocoating an article while applying pulsating electric current voltage, dipping the obtained electrocoated article in an aqueous solution of an organic sulfonic acid in an uncured state, and applying electric voltage to the electrocoated article as anode, wherein certain pulsating ratio at electrocoating is selected. According to the present invention, an even delustered coat having excellent physical properties is obtained. Further, it is possible to deluster the electrocoat to a desirable gloss with eveness.

12 Claims, No Drawings

METHOD OF DELUSTERING AN ELECTROCOATED ARTICLE

SUMMARY OF THE INVENTION

The present invention provides a method of delustering an electrocoated article which comprises dipping an uncured electrocoated article into an aqueous solution of an organic sulfonic acid, applying electric voltage to the article as anode, and pulling up and baking the article. The invention also provides a method of controlling the delustering by carrying out the electrocoating under a selected pulsating ratio of a pulsating electric current which is converted from alternating electric current, in addition to the above treatment by an organic sulfonic acid solution.

According to the present invention, an even delustered coat having excellent properties, for example, a high rigidity, an alkaline resistance and so on (ordinarily having a 60°-mirror surface reflectance of from 5 to 90) is obtained.

Further, it is possible to select a desirable degree of a delustering with evenness.

BACKGROUND OF THE INVENTION

Recently, delustered electrocoat, especially delustered aluminum sash, has become popular, and many methods of delustering have been proposed.

As a conventional delustering method, it has been known that a delustering pigment such as silicate can be mixed into electrocoatings.

However, in this method the delustering pigment is liable to precipitate or to coagulate, so that stability of the coatings is poor, and also, a coat having a constant and even gloss and a high alkaline resistance is difficult to be obtained.

A method of using delustering paint containing a resin poor in compatibility is known. However, the paint lacks stability and washability, and additionally often causes uneven appearance.

A method of obtaining a delustered coat in which an electrocoated article is dipped into an aqueous solution of inorganic acid, organic acid or salts before baking has been known. In this method, the delustering effect is insufficient, because the solution is washed off (if the washing process is omitted, the coated surface becomes uneven due to drops of the solution which form on and fall from the hanger for the article or edge of the article when it is pulled from the solution).

Japanese Patent Publication (KOKAI) No. 9392/1981 discloses that the delustering is achieved by the application of electric current to an electrocoated article in an aqueous solution of salts. However, the method causes uneven appearance. and gives an insufficient 60°-mirror reflectance, of less than 40.

Japanese Patent Publication (KOKAI) No. 54595/1980 discloses a method of delustering in which alternating electric current (A.C.) is applied on an electrocoated article in an aqueous solution of acid such as sulfonic acid, nitric acid, phosphoric acid, cresolsulfonic acid or p-toluene-sulfonic acid. However, the alternating electric current is essentially applied, which makes it difficult to control the gloss and gives rise to uneven appearance.

DETAILED DESCRIPTION OF THE INVENTION

The present invention relates to a method of delustering an electrocoated article and a method of controlling the delustering.

As aforementioned, there are many problems or defects in the conventional methods of delustering electrocoated articles. The object of the present invention is in the improvement of the above problems.

In accordance with the present invention, a method of delustering an electrocoated article is provided which comprises dipping an uncured electrocoated article into an aqueous solution of an organic sulfonic acid, applying electric voltage to the article as anode, and removing and baking the article.

Further, it has been found that the degree of the delustering can be suitably controlled, if the article is electrocoated under a certain pulsating ratio of a pulsating electric current which is converted from alternating current and is commonly used in an electrocoating, the electrocoated article is dipped into an aqueous solution of an organic sulfonic acid in an uncured state and electric voltage is applied to the article as anode followed by the pulling-up and drying of the article.

That is, according to a second aspect of the invention, a method of controlling delustering of an electrocoated article is provided which comprises electrocoating an article, dipping the uncured electrocoated article into an aqueous solution of an organic sulfonic acid, applying electric voltage to the article as anode, and pulling up and baking the article, wherein the electrocoating is achieved by applying pulsating electric current under a selected pulsating ratio.

The condition of the electrocoating according to the present invention is not different from the conventional one.

The electrocoating is carried out at a voltage of 2 to 300 volts, preferably 50 to 250 volts.

The organic sulfonic acid according to the present invention includes aliphatic sulfonic acid such as methanesulfonic acid, ethanesulfonic acid, 1,2-ethanedisulfonic acid, and the like; and aromatic sulfonic acid such as dinonylnaphthalenesulfonic acid, dinonylnaphthalenedisulfonic acid, dodecylbenzenesulfonic acid, 1-naphthalenesulfonic acid, 2-naphthalenesulfonic acid, 1-naphthylamine-4-sulfonic acid, 1-naphthylamine-2-sulfonic acid, naphtholsulfonic acid, naphtholdisulfonic acid, phenol-2,4-disulfonic acid, o-phenolsulfonic acid, m-phenolsulfonic acid, p-phenolsulfonic acid, p-bromobenzenesulfonic acid, 1,8-dioxy-3,6-naphthalenesulfonic acid, 1,2-dioxy-7-anthraquinonesulfonic acid, p-diazobenzene-sulfonic acid, p-chlorobenzenesulfonic acid, o-xylene-4-sulfonic acid, 1-anthraquinonesulfonic acid, o-aminobenzenesulfonic acid, sulfosalicylic acid, p-toluenesulfonic acid, m-toluenesulfonic acid, 5,5-indigodisulfonic acid, cresolsulfonic acid and the like, most preferably dinonylnaphthalenesulfonic acid and dinonylnaphthalenedisulfonic acid.

These organic sulfonic acids may be used singly or in combination at 0.01 to 1 percent by weight generally, more suitably 0.05 to 0.5 percent by weight in an aqueous solution.

Into the aqueous solution of the organic sulfonic acid, an alkaline component for example, ammonia or amines such as diethylamine, triethylamine, dimethylethanolamine, triethanolamine, morpholine, aniline, amylamine, isobutylamine, and isopropylamine, may be added to control the pH within a range of 1.0 to 12, preferably from 3 to 10.

Additionally, a water soluble organic solvent such as methyl alcohol, ethyl alcohol, isopropyl alcohol, ethyl cellosolve, butyl cellosolve, carbitol, acetone or a mixture thereof may be added into the above aqueous solution generally within 0.1 to 10 percent by weight, preferably 0.5 to 5 percent by weight, so as to improve effectively the electrocoat in evenness of the appearance.

The addition of the organic solvent is especially preferable because that, particularly in case that the electrocoated article is washed before baking, the organic solvent improves the affinity to the washing liquid to make the coat more even.

According to the present invention, the electrocoated article is dipped into the aforementioned aqueous solution of the organic sulfonic acid in an uncured state and electrical voltage is applied to the electrocoated article as anode.

The article may be electrocoated using conventional electrocoatings, for example, anionic electrocoatings such as clear paint of acryl resin-melamine resin, clear paint of epoxy resin-melamine resin, clear paint of urea resin-melamine resin, clear paint of alkyd resin-melamine resin and the like, preferably clear paint of acryl resin-melamine resin.

Preferable articles are aluminum, aluminum alloy, iron, iron alloy, magnesium alloy, copper alloy and the like, particularly aluminum or aluminum alloy is preferable. The temperature of the organic sulfonic acid solution is generally 15° to 25° C.

The electric current is preferably direct current [D.C.] or pulsating current.

The time of the application of the voltage is, for example, generally 0.5 to 15 minutes, preferably 1 to 5 minutes, at 10 to 250 V in case of direct current, but is not restricted, and is selected based on the manner of application, temperature of the dipping solution, concentration of the solution and the like.

The electrocoated article treated with the organic acid solution is pulled up i.e., removed, from the solution and baked without or after washing.

As the washing liquid tap water, pure water, ultrafiltrate, filtrate of reverse osmosis or water containing surfactant may be used.

The electrocoated article is generally baked at 150° C. to 200° C. for 15 to 40 minutes, preferably at 170° to 190° C. for 20 to 30 minutes, though depending on the electrocoatings, the kind of articles to be coated and so on, but is not restricted.

According to the present invention, an even delustered coating having an excellent coating property, for example, a high rigidity, an alkaline resistance and so on, and an even appearance (ordinarily having a 60°-mirror reflectance of 5 to 90 percent) is obtained by selecting a suitable temperature and concentration of the organic sulfonic acid solution, voltage, application time, and the like.

Further, according to the present invention, the electrocoating bath remains stable unlike the case of using non-luster coatings, and in addition, devices for ultrafiltration, reverse osmosis, ion exchange and the like can be omitted. Additionally the merits of the present invention are a low concentration of the treating solution, an economical operation and lower baking temperature or shorter baking time than those using conventional delustering coatings. Further, in comparison with delustering by alternating electric current, it is easy to control the gloss of the electrocoated articles and to improve the evenness of their appearance.

It has been found that the degree of the delustering can be controlled by the selection of the pulsating ratio during the electrocoating.

The pulsating ratio according to the present invention is indicated by the following expression:

$$\text{pulsating ratio} = \frac{\text{maximum voltage} - \text{minimum voltage}}{\text{average voltage}} \times 100$$

It is preferable to select the pulsating ratio within a range of 10 to 140 percent. When desirable to increase the delustering, a smaller pulsating ratio is selected during the electrocoating, whereas when desirable to decrease it, a larger pulsating ratio is selected. That is, the luster decreases as the pulsating ratio increases.

The conditions for electrocoating may be adopted according to an ordinary manner excepting the selection of the pulsating ratio, and the delustering using the organic sulfonic acid solution may be achieved in the same manner as aforementioned.

According to the method of controlling delustering of the present invention, it is possible to select a desirable delustering with evenness, excellent properties such as hardness, alkaline resistance and the like. Especially, a suitable delustered coated surface having a 60°-mirror reflectance of 5 to 90 percent is easily obtained by selecting a suitable pulsating ratio under fixed conditions, for instance, the concentration, temperature of sulfonic acid solution or others (the variation of these conditions may cause some troubles in the operation).

The present invention is applicable to any electric conductive article, particularly aluminum sash.

The present invention is illustrated by the following Examples, in which all parts and percentages are by weight unless otherwise specified.

EXAMPLES 1 TO 10

Anodized aluminum plates (70 mm×150 mm×0.8 mm) prepared according to JIS H 9500 are vertically dipped into electrocoating bath containing Powermite 3000 (acryl-melamine resin type anionic electrocoatings, available from Nippon Paint) diluted to 10 percent solid by deionized water at 21° C., and the voltage is applied to the anodic plates at 120 V for 2.5 minutes. The obtained coated articles are pulled up from the bath and washed by tap water.

The resultant wet electrocoated articles are dipped into various kinds of organic acid solution as described in Table-1 and D.C. voltage is applied to the electrocoated plates as anode at given voltages for given times as shown in Table-1. The treated articles are pulled up from the solution, washed and dried under given baking conditions, but in Example 8 washing is omitted.

The results are shown in Table-1.

COMPARATIVE EXAMPLE 1

An electrocoated article is prepared in the same manner as described in Examples 1 to 10, excepting that the treatment with the organic sulfonic acid solution is omitted. The properties of the obtained article are shown Table-1.

TABLE 1

| | Example | | | | | | | | | | Comparative Example |
|---|---|---|---|---|---|---|---|---|---|---|---|
| | 1 | 2 | 3 | 4 | 5 | 6 | 7 | 8 | 9 | 10 | 1 |
| Conditions for Treatment of Electrocoated Article | | | | | | | | | | | |
| Solution for Treatment | A[1] | B[2] | C[3] | | A | | D[4] | A | E[5] | F[6] | — |
| Concentration of Sulfonic Acid in Solution for Treatment (%) | 0.05 | 0.025 | 0.05 | 0.01 | | 0.05 | 1 | 0.05 | 0.095 | 0.205 | |
| Temperature of Solution for Treatment (°C.) | | 20 | 25 | | 20 | 10 | | | 20 | | |
| Voltage (V) | | 150 | 100 | | 150 | 250 | 10 | | 150 | | |
| Passing Time of Current (minutes) | | | 2.5 | | | 0.5 | 15 | | 2.5 | | |
| Washing Liquid | W | W | W | W | UF | RO | W | — | W | W | |
| Washing process | dip | st | st | st | dip | dip | st | | st | st | |
| Baking Temperature (°C.) | | | 190 | | 170 | | | | | 190 | |
| Baking Time (minutes) | | | | | | | 30 | | | | |
| Properties of Coating | | | | | | | | | | | |
| Gloss (%)[7] | 20 | | 30 | | 20 | 50 | 60 | 25 | 60 | 50 | 110 |
| Pencil Handness | | | 5 H | | 4 H | | 5 H | | | | 4 H |
| Appearance of Coated Surface | | | | | E | | | | | SLS | E |
| Physical and Chemical Properties | | | | | | | 8 | | | | |

W: water,
UF: ultrafiltrate,
RO: reverse osmosis
dip: dipping,
st: stream
E: excellent,
SLS: a slight luster stain
[1]solution containing dinonylnaphthalenedisulfonic acid 1.0 g, triethylamine 0.6 g, butyl cellosolve 10.0 g and pure water 1988.4 g (pH 10.2), with Example 4 using a one-fifth dilute solution,.
[2]solution containing dinonylnaphthalenesulfonic acid 0.5 g, triethylamine 0.1 g, butyl cellosolve 5.0 g and pure water 1994.4 g (pH 10.0),
[3]solution containing methanesulfonic acid 1.0 g, diethylamine 0.6 g, isopropyl alcohol 5.0 g and pure water 1993.4 g (pH 11),
[4]solution containing dinonylnaphthalenedisulfonic acid 20.0 g, triethylamine 4.0 g, butyl cellosolve 200.0 g, and pure water 1768.0 g (pH 3.0),
[5]solution containing p-toluenesulfonic acid 1.9 g and pure water 1998.1 g (pH 2),
[6]solution containing p-toluenesulfonic acid 1.9 g, sulfosalicylic acid 2.2 g and pure water 1995.9 g (pH 1.5),
[7]60°-mirror reflectance,
[8]pass JIS H-8602.

EXAMPLE 11

Anodized aluminum plate (70 mm×150 mm×0.8 mm) prepared according to JIS H 9500.7.2 is dipped into an aqueous solution of Powermite 3000 (acryl resin-melamine resin type anionic electrocoatings) diluted to 10 percent solid. Direct electric current is applied to the plate as anode at 120 V (pH 4.4, 20° C.). The coated article is pulled up and washed with tap water by dipping.

The obtained electrocoated article is dipped into the solution containing dinonylnaphthalenesulfonic acid 1.0 g, triethylamine 0.6 g, butyl cellosolve 10.0 g, and pure water 1988.4 g at 20° C. and direct current is applied to the plate at a voltage of 150 V for 2.5 minutes. The treated plate is pulled up from the solution and washed with water by dipping followed by baking at 190° C. for 30 minutes.

The coat has an even surface with 60°-mirror reflectance of 20. The physical and chemical properties pass the test of JIS H-8602.

The substantially same results are obtained from aluminum alloy plate as from the above anodized aluminum.

COMPARATIVE EXAMPLE 2

The electrocoated plate obtained in Example 11 is dipped into aqueous solution of one percent tartaric acid (20° C.) in uncured state. 150 V-D.C. is applied to the article as anode for 2.5 minutes and the article is pulled up, washed with tap water and baked at 190° C. for 30 minutes. The obtained coat has a 60°-mirror reflectance of 90.

COMPARATIVE EXAMPLE 3

The wet electrocoated plate obtained in Example 11 is dipped into an aqueous solution of one percent succinic acid (20° C.). 150 V-D.C. is applied to the article as anode for 2.5 minutes and the article is pulled up, washed with tap water by dipping and cured at 190° C. for 30 minutes. The obtained coat has a 60°-mirror reflectance of 95.

COMPARATIVE EXAMPLE 4

The wet electrocoated plate obtained in Example 11 is dipped into the solution containing dinonylnaphthalenefonic acid 1.0 g, triethylamine 0.6 g, butyl cellosolve 10.0 g and pure water 1988.4 g at 29° C. for 2.5 minutes without the application of D.C. voltage and the article is pulled up from the solution. The obtained article is washed with water by dipping and cured at 190° C. for 30 minutes.

The coat has a 60°-mirror reflectance of 101.

COMPARATIVE EXAMPLE 5

The wet electrocoated plate obtained in Example 11 is dipped into the solution containing dinonylnaphthalenedisulfonic acid 1.0 g, triethylamine 0.6 g, butyl cellosolve 10.0 g and pure water 1988.4 g at 20° C. and 150 V-A.C. is applied to the uncured coated plate for 2.5 minutes. The treated plate is pulled up from the solution, washed with tap water by dipping and then baked at 190° C. for 30 minutes to give an uneven coat having a 60°-mirror refectance of 95 on average and a pencil hardness of 4 H with even appearance.

EXAMPLES 12 TO 17

Aluminum plates (70 mm×150 mm×0.8 mm) prepared according to JIS H9500 are dipped in Powermite 3000 (acryl resin-melamine resin type anionic electrocoatings), which are diluted with pure water to 10 percent solid. Pulsating electric current is applied to the above plates as anode at 20° C. at average voltage of 120 V for 2.5 minutes in a different pulsating ratio. The obtained electrocoated articles are pulled up from the electrocoating bath and are washed by dipping.

The above electrocoated articles are dipped into an aqueous solution of dinonylnaphthalenedisulfonic acid (10%), the pH of which is controlled at 7 to 8 with triethylamine, and 150 V-D.C. is applied to the articles as anode for 2.5 minutes, and the articles are then pulled up from the solution. The treated articles are washed and baked at 170° C. for 30 minutes.

The properties of the delustered coating are shown in Table-2.

The substantially same results are obtained from aluminum alloy plate as from the above anodized aluminum.

TABLE 2

| | Example | | | | | |
|---|---|---|---|---|---|---|
| | 12 | 13 | 14 | 15 | 16 | 17 |
| Condition of Electrocoating | | | | | | |
| Pulsating Ratio (%) | 10 | 20 | 40 | 60 | 100 | 140 |
| Voltage (V) | 120 | 120 | 120 | 120 | 120 | 120 |
| Condition of Delustering | | | | | | |
| Concentration (%) | 0.05 | 0.05 | 0.05 | 0.05 | 0.05 | 0.05 |
| Voltage (V) | 150 | 150 | 150 | 150 | 150 | 150 |
| Properties of Coat | | | | | | |
| Gloss | 20 | 25 | 30 | 40 | 80 | 80 |
| Hardness | 5 H | 5 H | 4–5 H | 4 H | 4 H | 4 H |
| Appearance of coat surface | E | | | | | |
| Physical and Chemical Property | pass JIS H-8602 | | | | | |

E: excellent

We claim:

1. A method of delustering an electrocoated article, which comprises dipping the electrocoated article into an aqueous solution of an organic sulfonic acid while the article is in an uncured state, applying direct electric current or pulsating electric current to the article as anode, removing the article from the solution, and baking the article.

2. A method of delustering an electrocoated article according to claim 1, in which the organic sulfonic acid is dinonylnaphthalenesulfonic acid or dinonylnaphthalenedisulfonic acid.

3. A method of delustering an electrocoated article according to claim 1, in which the aqueous solution of an organic sulfonic acid is controlled to pH 1.0 to 12 by adding ammonia or an amine thereto.

4. A method of delustering an electrocoated article according to claim 1, in which the aqueous solution contains 0.1 to 10 percent by weight of a water soluble organic solvent.

5. A method of delustering an electrocoated article according to claim 1, in which the electric current is a direct electric current and is applied at a D.C. voltage of 10 to 250 V.

6. A method of delustering an electrocoated article according to claim 5, in which the direct electric current is applied for 0.5 to 15 minutes.

7. A method of delustering an electrocoated article according to claim 1, in which the electrocoated article is baked without washing after removal from the solution.

8. A method of delustering an electrocoated article according to claim 1, in which the electrocoated article is washed before baking.

9. A method of delustering an electrocoated article according to claim 1, in which the concentration of the organic sulfonic acid is from 0.01 to 1 percent by weight.

10. A method of controlling gloss of an electrocoated article, which comprises electrocoating an article while applying pulsating electric current voltage to the article, dipping the resultant electrocoated article into an aqueous solution of an organic sulfonic acid while the electrocoated article is in an uncured state, applying direct electric current or pulsating electric current to the electrocoated article as anode, removing the electrocoated article from the solution, and baking the electrocoated article.

11. A method of controlling gloss of an electrocoated article according to claim 10, in which the pulsating ratio during electrocoating is selected within 10 to 140 percent.

12. A method of controlling gloss of an electrocoated article according to claim 10, in which the organic sulfonic acid is dinonylnaphthalenesulfonic acid or dinonylnaphthalenedisulfonic acid.

* * * * *